US011084649B2

(12) United States Patent
Chatelain et al.

(10) Patent No.: US 11,084,649 B2
(45) Date of Patent: Aug. 10, 2021

(54) CONTAINER WITH INNER STIFFENER FOR SMOKING ARTICLES, INNER STIFFENER, METHOD

(71) Applicant: PHILIP MORRIS PRODUCTS S.A., Neuchatel (CH)

(72) Inventors: Lucas Chatelain, Lausanne (CH); Luiz Andre Rodrigues, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 297 days.

(21) Appl. No.: 16/098,990

(22) PCT Filed: May 10, 2017

(86) PCT No.: PCT/EP2017/061216

§ 371 (c)(1),
(2) Date: Nov. 5, 2018

(87) PCT Pub. No.: WO2017/194621

PCT Pub. Date: Nov. 16, 2017

(65) Prior Publication Data

US 2019/0152686 A1 May 23, 2019

(30) Foreign Application Priority Data

May 12, 2016 (EP) ..... 16169430

(51) Int. Cl.
*B65D 85/10* (2006.01)

(52) U.S. Cl.
CPC ..... *B65D 85/1009* (2013.01); *B65D 85/1081* (2013.01); *B65D 85/10568* (2020.05)

(58) Field of Classification Search
CPC ..... B65D 85/10; B65D 85/1009; B65D 85/1045; B65D 85/1036; B65D 85/1081;

(Continued)

(56) References Cited

U.S. PATENT DOCUMENTS 1,755,579 A * 4/1930 Grupe ..... B65D 75/38 206/267
1,953,418 A * 4/1934 MacDonald ..... B65D 85/1009 206/739

(Continued)

FOREIGN PATENT DOCUMENTS

CN 201052889 Y 4/2008
CN 201276281 7/2009

(Continued)

OTHER PUBLICATIONS

PCT International Search Report and Written Opinion for PCT/EP2017/061216 dated May 26, 2017 (12 pages).

(Continued)

*Primary Examiner* — Chun Hoi Cheung
*Assistant Examiner* — Brijesh V. Patel
(74) *Attorney, Agent, or Firm* — Mueting Raasch Group

(57) ABSTRACT

A container 10 for smoking articles 30 having an outer housing comprising a box 12 and a lid 14 hingedly attached to the box, an inner liner 20 disposed within the outer housing, the inner liner defining an interior volume for the smoking articles, the inner liner being sealed around the smoking articles and having an access opening 26 with a closure flap. An inner stiffener 50 having at least side walls 58 hingedly connected to a main panel for at least partially surrounding the smoking articles is provided within the inner liner, the main panel being hingedly connected to a bottom panel 54 that includes a stepped region 60 for receiving at least part of a smoking article provided in line with the access opening 26.

8 Claims, 2 Drawing Sheets

(58) Field of Classification Search
CPC . B65D 5/38; B65D 5/728; A24F 15/12; A24F 15/16; A24F 15/18; A24F 15/00; Y10S 206/804; Y10S 493/91; Y10S 493/911
USPC ..... 206/273, 268, 250, 254, 271, 248, 804, 206/249, 259, 236, 37, 565, 739; 229/160.1, 87.13, 104, 122.21
See application file for complete search history.

(56) References Cited

U.S. PATENT DOCUMENTS 2,039,559 A * 5/1936 Segal ..... A24F 15/18 206/250
2,391,285 A * 12/1945 Williamson ..... A47F 5/112 206/565
3,058,581 A * 10/1962 Keating ..... B65D 75/54 206/256
3,081,867 A * 3/1963 Corey ..... A24F 15/12 206/248
3,107,008 A * 10/1963 Margulies ..... B65D 85/1036 206/249
3,279,593 A * 10/1966 Cote ..... B65D 5/721 206/255
3,752,307 A * 8/1973 German ..... B65D 5/0245 206/521
3,836,066 A * 9/1974 Del Priore ..... B65D 5/0245 206/521
4,241,827 A * 12/1980 Focke ..... B65D 85/1036 206/267
4,586,605 A * 5/1986 Newsome ..... B65D 85/1036 206/267
4,850,482 A * 7/1989 Campbell ..... B65D 85/1081 206/273
5,158,664 A * 10/1992 Colgan ..... B65D 85/1045 206/242
5,558,217 A * 9/1996 Focke ..... B65D 85/1081 206/268
5,584,389 A 12/1996 Focke
6,412,630 B2 * 7/2002 Focke ..... B65D 85/1081 206/268
6,449,926 B1 * 9/2002 Focke ..... B65D 85/1045 493/162
6,676,013 B2 * 1/2004 Auclair ..... B65D 5/38 229/122
6,874,623 B2 * 4/2005 Bray ..... B65D 75/5838 206/264
7,383,950 B1 * 6/2008 Roberts ..... B65D 85/1081 206/256
7,832,556 B2 * 11/2010 Ghini ..... B65D 85/1081 206/268
8,276,750 B2 * 10/2012 Biondi ..... B65D 77/02 206/259
8,757,371 B2 * 6/2014 Draghetti ..... B65D 85/10564 206/270
9,533,821 B2 * 1/2017 Buse ..... B65D 85/1045
9,950,859 B2 * 4/2018 Steinkamp ..... B65D 77/30
2003/0034255 A1 * 2/2003 Luton ..... B65D 85/1045 206/268
2008/0296184 A1 12/2008 Wu
2009/0008277 A1 1/2009 Agirbas
2015/0122676 A1 5/2015 Brugger
2015/0232261 A1 8/2015 Brugger

FOREIGN PATENT DOCUMENTS

| | | |
|---|---|---|
| CN | 104053612 | 9/2014 |
| CN | 104271465 | 1/2015 |
| FR | 1081649 | 12/1954 |
| FR | 2597077 | 10/1987 |
| JP | H0752981 | 2/1995 |
| JP | 2009 046196 | 3/2009 |
| WO | WO 2011 009520 | 1/2011 |
| WO | WO 2011/060795 | 5/2011 |

OTHER PUBLICATIONS

Office Action issued in China for Application No. 201780025403.3 dated Jun. 24, 2019 (14 pages). English translation included.
Office Action issued in Korea for Application No. 10-2018-7031139 dated Sep. 29, 2019 (11 pages). English translation included.

* cited by examiner

CONTAINER WITH INNER STIFFENER FOR SMOKING ARTICLES, INNER STIFFENER, METHOD

This application is a U.S. National Stage Application of International Application No. PCT/EP2017/061216 filed May 10, 2017, which was published in English on Nov. 16, 2017, as International Publication No. WO 2017/194621 A1. International Application No. PCT/EP2017/061216 claims priority to European Application No. 16169430.2 filed May 12, 2016.

The present invention relates to a container for smoking articles, such as cigarettes. In particular, the present invention relates to a container that includes an inner liner sealed around the smoking articles with an inner stiffener between the inner liner and the smoking articles.

Smoking articles such as cigarettes and cigars are commonly packaged in rigid hinge-lid containers having a box and a lid connected to the box portion about a hinge line extending across the rear wall of the container. Such hinge-lid containers are typically constructed from one-piece laminar cardboard blanks. In use, the lid portion is pivoted about the hinge line to open the container and so gain access to smoking articles housed in the box portion.

A group of smoking articles housed in the box portion is typically wrapped in an inner liner of metallized paper, metal foil or other flexible sheet material, to form an inner bundle.

To improve the barrier properties of the inner package, the inner liner wrapped around the smoking articles may be heat sealed and sometimes has a cigarette access opening closed by a reusable cover flap. A cardboard stiffener, for example in the form of a U-shaped frame, may be placed inside the inner bundle about the articles to maintain the shape of the inner package and to protect the smoking articles when folding and heat sealing the inner liner around the articles. It is important for the shape of the inner bundle to be maintained so that the contents may be withdrawn through the access opening. However, it can be difficult to withdraw a first article from the package due to the tight packing of the bundle.

International patent application WO 2011/012235 A1 describes a container for smoking articles which includes a lifting element with an engaging portion engageable with an outside upper end portion of the smoking article. The lifting element extends from the opening of the box and has a hook for engaging a ring-like shoulder formed by an edge of tipping paper wrapped around the smoking article. The lifting agent may be attached to a pull foil of the inner liner.

International patent application WO 2009/004421 A2 discloses a similar type of package for smoking articles which includes an inner stiffener that is able to exert an elastic thrust on the group of smoking articles by means of concertina side walls so as to keep the group of articles in a central position facing the access opening.

The present invention seeks to provide an improved container for smoking articles that aids removal of a smoking article from the container, in particular aiding removal of a first or final smoking article from a bundle of articles.

Accordingly, one aspect of the invention provides a container for smoking articles comprising an outer housing comprising a box and a lid hingedly attached to the box, wherein the box comprises a front wall, a rear wall and opposing side walls; an inner liner disposed within the housing, the inner liner defining an interior volume for the smoking articles, the inner liner being sealed around the smoking articles and having an access opening with a closure flap; and an inner stiffener having at least side walls hingedly connected to a main panel for at least partially surrounding the smoking articles within the inner liner, the main panel being hingedly connected to a bottom panel, wherein the bottom panel includes a stepped region for receiving at least part of a smoking article provided in line with the access opening.

Advantageously, by the provision of a modified inner stiffener placed between the smoking articles and the inner liner, where the stiffener has a bottom panel with a stepped region for receiving at least part of a smoking article at least one or more of the smoking article may be raised partially through the opening relative to other articles outside of the stepped region. This advantageously allows a consumer to easily grab the protruding end of a raised smoking article. The invention is in particular advantageous as it provides the inner stiffener with a second function other than to protect the smoking articles during production, in particular during sealing.

The box may include a box front wall, a box left side wall, a box right side wall, a box back wall and a box bottom wall. The lid may include a lid front wall, a lid left side wall, a lid right side wall, a lid back wall and a lid top wall.

The inner liner, inner stiffener and smoking articles together form an inner bundle. The container may also include an inner frame disposed between the inner bundle and the box of the housing. Prior to first opening, the filled container may be wrapped in an outer wrapping film.

The stepped region of the bottom panel raises at least one smoking article partially through the access opening relative to the other smoking articles outside of the stepped region. The stepped region may be collapsible, being movable between a flattened and an erect state. The depth and width of the stepped region may be selected according to the size and number of smoking articles to be raised through the opening. Preferably, the depth and width of the stepped region corresponds to at least a radius of at least one smoking article, more preferably the depth and width of the stepped region corresponds to between about 50 percent and about 80 percent of the diameter of at least one smoking article. To raise smoking articles only on the front row of the pack, it is advantageous to have a stepped region that is smaller than the diameter of the smoking articles due to the nesting of the smoking articles between the first and the second row.

In an embodiment, the access opening extends partially into the front wall of the container and the main panel is a front panel, the stepped region of the bottom panel being provided by a hinge line between the front and bottom panels, the hinge line being at least partially stepped inwardly to create a ledge in line with the access opening for forming the stepped region. Alternatively, or additionally, the access opening may extend partially into the rear wall of the container and the main panel is a rear panel, the stepped region of the bottom panel being provided by a hinge line between the rear and bottom panels, the hinge line being at least partially stepped inwardly to create a ledge in line with the access opening for forming the stepped region.

The stepped region may be formed in the inner stiffener by providing a pair of substantially parallel longitudinal cut lines extending across the hinge line of the main and bottom panels with three substantially parallel transverse weakening lines provided between the cut lines for folding to form the stepped region. The cut lines are of equal length. Preferably, a front weakening line extends between ends of the cut lines in the main panel, a bottom weakening line extends between ends of the cut line in the bottom panel and a middle weakening line is provided between the front and bottom weakening lines. In a preferred embodiment, the middle weakening line is provided substantially centrally between the front and bottom weakening lines but is displaced with respect to the hinge line of the main and bottom panels. The cut lines are preferably located centrally across the hinge line of the main and bottom panels but the distance between the cut lines and the length of the cut lines will depend upon the desired size of the stepped region. The weakening line may be any of a creasing line, a scoring line, a perforated line, an ablated line, a fold line or any other line that locally reduces the structural integrity of the inner stiffener material, or any combination thereof.

The displacement of the middle weakening line relative to the hinge line of the main and bottom panel is preferably a maximum of 25 percent of the distance between the first and middle weakening line and the second and middle weakening line.

Preferably, the weakening lines are spaced from each other by between about 0.3 mm and 4 mm. Preferably, the spacing of the weakening lines is a function of the thickness of the inner stiffener. Preferably, the spacing between the weakening lines is between about 2 and about 20 times larger than the thickness of the stiffener.

The container, inner frame, inner bundle, and outer wrapper may be formed from any suitable materials including, but not limited to, cardboard, paperboard, plastic, metal or combinations thereof. In a preferred embodiment, the inner liner comprises metallized paper or metal foil and the inner stiffener is comprised of cardboard. The cardboard may have a weight of between about 100 grams per square meter and about 350 grams per square meter.

Containers according to the invention may be in the shape of a rectangular parallelepiped, with right-angled longitudinal and right-angled transverse edges. Alternatively, the container may include one or more rounded longitudinal edges, rounded transverse edges, bevelled longitudinal edges, or bevelled transverse edges, or combinations thereof.

Containers according to the invention find particular application as packs for elongated smoking articles such as, for example, cigarettes, cigars or cigarillos. It will be appreciated that through appropriate choices of the dimensions of the container, containers according to the invention may be designed for different numbers of conventional size, king size, super-king size, slim or super-slim cigarettes.

Through an appropriate choice of dimensions, containers according to the invention may be designed to hold different total number of smoking articles, or different arrangements of smoking articles. For example, through an appropriate choice of the dimensions, containers according to the invention may be designed to hold a total of between ten and thirty smoking articles.

The lid of the housing is hingedly attached to the box and is adapted to be manipulated between an open position and a closed position. In the open position, the consumer can access the consumer goods disposed within the housing following opening of the inner bundle. The lid can be hingedly attached to the box along a hinge line that extends across a rear wall of the container. The term "hinge line" refers to a line about which the lid may be pivoted to open the container. A hinge line may be, for example, a fold line or a score line in the panel forming the back wall of the housing.

The inner liner is preferably wrapped around the inner stiffener which has been placed around the smoking articles and then the liner is sealed at its overlapping edges. Preferably, the inner liner has a front wall, a rear wall, opposing side walls, a top wall and a bottom wall, preferably being sealed at overlapping regions provided on one or both side walls. The inner liner has an access and the closure flap preferably comprises a re-sealable flap. The closure flap may be provided with a tab. In some embodiments, the tab may be attached to the inside of the lid of the container, such that opening the lid automatically also lifts or peels the label from the access opening in the inner liner. Preferably, in some of these embodiments, the label that is attached to the lid forms an s-shaped curve when the pack is opened.

The access opening may be formed by a pre-perforated portion of the inner liner that is removed upon first opening of the inner liner which is then closed by the closure flap. In one or more embodiments, the access opening can be disposed such that it is located on a front wall of the inner bundle. In one or more embodiments, the access opening can be disposed such that it is located on a top wall of the inner bundle. In one or more embodiments, the access opening can be disposed such that it is located across a portion of the front wall and the top wall of the inner bundle. Alternatively, the access opening may also additionally be located at the top wall and the back wall of the bundle, or the access opening may extend over the front wall, the top wall and the back wall of the bundle. The access opening can take any suitable shape or combination of shapes.

The closure flap is adapted to reattach to the inner liner when the flap is in the closed position. Preferably, the closure flap is adapted to overlap the access opening in a seal region such that the flap attaches to the inner liner within the seal region when the closure flap is in the closed position. The adhesive disposed between the closure flap and the seal region allows for repeated opening and closing of the flap so that the smoking articles disposed within the inner bundle can be accessed when the closure flap is in the open position, and so that the articles remain sealed within the inner bundle when the closure flap is in the closed condition. Preferably, the adhesive disposed between the closure flap and the seal region provides sufficient adhesion for the flap to be reattached at least as many times as there are smoking articles within the inner bundle such that the consumer can open and reseal the inner bundle until it is empty.

In another aspect of the present invention there is provided an inner stiffener member for placement around a charge of smoking articles, the inner stiffener comprising at least side walls hingedly connected to a main panel for placement adjacent sides and a face of a charge of smoking articles respectively and a bottom panel hingedly connected to the main panel wherein a pair of substantially parallel longitudinal cut lines extend across the hinge line of the main and bottom panels and three substantially parallel transverse weakening lines are provided between the cut lines for folding to form a stepped region.

In a preferred embodiment, a front weakening line extends between ends of the cut lines in the main panel, a bottom weakening line extends between ends of the cut line in the bottom panel and a middle weakening line is provided between the first and bottom weakening lines. Preferably, the cut lines are of an equal length. Preferably, the middle weakening line is provided substantially centrally between the first and bottom weakening lines but is displaced with respect to the hinge line of the main and bottom panels. The displacement of the middle weakening line relative to the hinge line of the main and bottom panel is preferably a maximum of 25 percent of the distance between the first and middle weakening line and the second and middle weakening line.

It is to be appreciated that the main panel of the stiffener may be a front or rear panel of the inner stiffener for placement adjacent front or rear faces of the bundle of smoking articles respectively, or both.

Another aspect of the present invention provides a method of packaging a charge of smoking articles, the method comprising: placing on a main panel of an inner stiffener a plurality of smoking articles in a predetermined location and angular orientation to form a charge of smoking articles, the inner stiffener including at least side walls and a bottom panel hingedly connected to the main panel, the bottom panel including a collapsed stepped region; folding the side walls to lie adjacent sides of the charge of smoking articles; folding the bottom panel to lie adjacent ends of the charge of smoking articles; extending the stepped region inwardly towards the smoking articles to misalign at least one smoking article relative to the other smoking articles; and wrapping and sealing an inner liner around the inner stiffener and charge of smoking articles to form an inner bundle.

In a preferred embodiment, a laminar blank is folded around the inner bundle to form an outer housing containing the bundle of smoking articles. A transparent outer wrapping film with tear tape may be sealed around the outer housing.

Referring now to the drawings, in which some aspects of the invention are illustrated.

Figure 1:
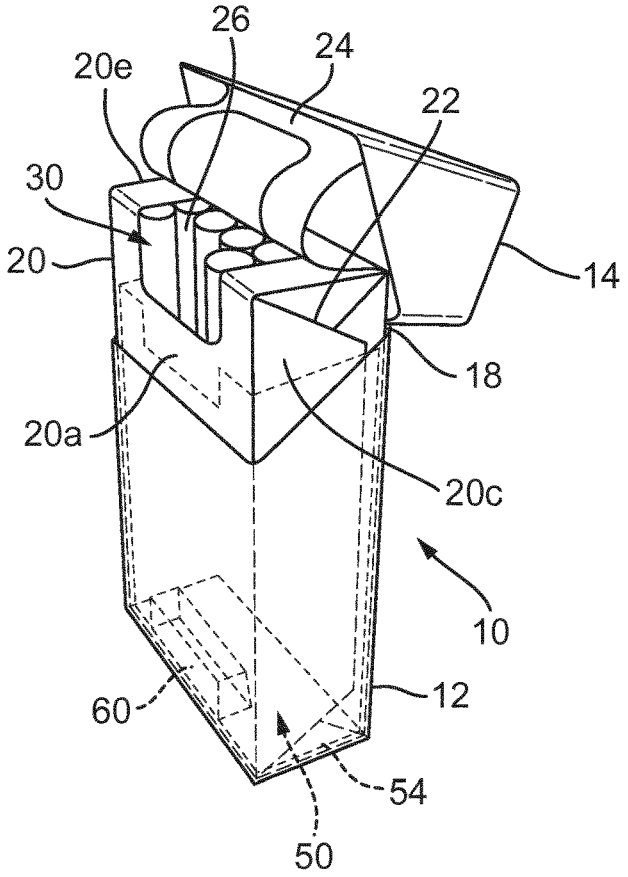
FIG. 1 is a schematic perspective front view of a container according to an embodiment of the invention, shown with the outer housing and an inner liner in an open position and illustrating with phantom lines the position of an inner stiffener.

Referring to FIG. 1, a schematic perspective view of an embodiment of a container 10 for smoking articles is depicted. The container 10 includes an outer housing in the form of a box 12 and a lid 14 hingedly attached to the box via a hinge line 18. The hinge line 18 extends across the back of the box 14 of the container 10, and acts to allow the lid 14 to be moved from a closed position (not shown) to an open position (shown). An inner liner 20 is disposed within the housing. The inner liner 20 is made from a barrier material or materials to substantially hermetically seal the smoking articles before the container is opened for the first time. The barrier material may be a metal foil or a plastic and metal laminate.

The inner liner 20 is made from a sheet of material with the liner being wrapped around a bundle of smoking articles, for example cigarettes 30, to form an inner bundle having a front wall 20*a*, a back wall 20*b*, opposing side walls 20*c*, a bottom wall 20*d* and top wall 20*e*. A permanent adhesive is used to seal overlapping folded regions 22 of the sheet thereby sealing the goods within the bundle. An access opening 26 is provided in the top and front walls for accessing the contents of the bundle, the opening having a resealable tab 24.

The inner bundle also includes an inner stiffener 50 disposed within the inner liner 20. An inner frame (not shown) may also be provided between the inner liner and the box. The inner stiffener is made from a cardboard blank (see FIGS. 3 and 4) that at least partially surrounds the smoking articles within the bundle to impart strength to the bundle and includes a stepped region providing the additional function of raising one or more of the smoking articles contained within the bundle relative to other articles to allow easier access to the contents of the container.

Figure 3:
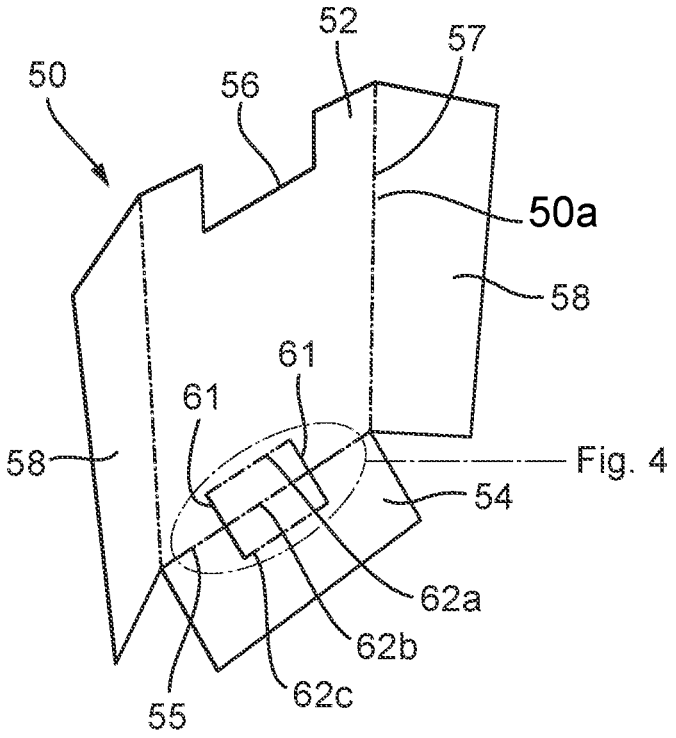
FIG. 3 is a schematic perspective view of one embodiment of an inner stiffener for a container according to the present invention.
Figure 4:
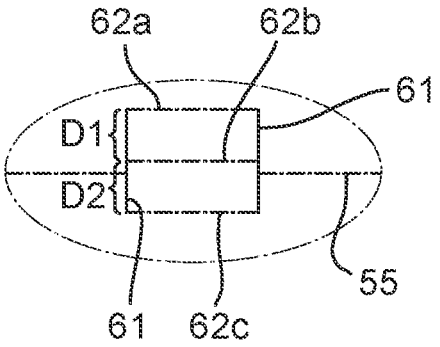
FIG. 4 is an enlarged view of the stepped region of the inner stiffener shown in FIG. 3.

In one embodiment, the inner stiffener 50 has opposing side walls 58 hingedly connected by crease lines 57 to a front panel 52 for at least partially surrounding the smoking articles 30 within the inner liner 20. The top edge of the front panel 52 is provided with a recess 56. The front panel is also hingedly connected by crease lines 55 to a bottom panel 54 that includes a stepped region 60 for receiving at least part of a smoking article provided in line with the access opening 26. The stepped region 60 within the inner stiffener blank 50*a* is formed from a series of parallel cuts and crease lines provided in the front and bottom panels, as shown in FIG. 3 and in expanded detail in FIG. 4.

Two parallel longitudinal cut lines 61 of substantially equal length are located centrally across crease line 55. Transverse crease lines 62*a*, 62*c* are provided between the corresponding ends of the cut lines 61 and a third transverse crease line 62*b* extends between the cut lines centrally between crease lines 62*a*, 62*c* to divide the region bounded by the longitudinal cut lines 61 and crease lines 62*a*, 62*c* into two equal parts D1 and D2 (see FIG. 4). Crease line 62*b* is misaligned with the crease line 55 between the front and bottom panels. In this manner, when the front and bottom panels are folded substantially perpendicularly to one another to surround the smoking articles, a stepped region 60 is formed between the panels to raise one or more of the articles that are in contact with the stepped region of the stiffener.

It is to be appreciated that the length of the longitudinal cut lines 61 and the distance between the lines will depend upon the number of smoking articles to be received on the stepped region formed from the lines. For example, the depth and width of the stepped region may correspond at least to the radius of a single smoking article, more preferably being at least about 70 percent of the diameter of a single smoking article.

The stepped region could be provided elsewhere on the bottom panel of the stiffener. For example, a back panel may be provided hingedly connected to the bottom panel with a stepped region provided across the hinge line. This would serve to raise the final smoking article in the bundle to provide easier access to this article in the bundle. Also, depending on the position of the access opening, also a position of the step on a side wall of the inner stiffener would be possible.

Figure 2:
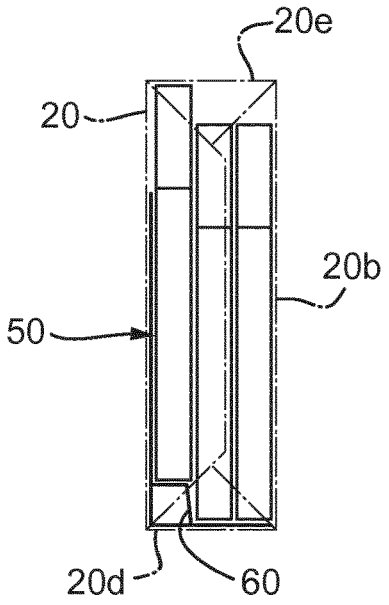
FIG. 2 is a schematic side view of a closed inner bundle illustrating the positioning of the smoking articles.

Packaging of the smoking articles is achieved by placing a plurality of smoking articles 30 on the main panel of the inner stiffener 50 in a predetermined location and angular orientation to form a charge of smoking articles. The side walls 58 of the inner stiffener are folded inwardly to lie adjacent sides of the charge of smoking articles and the bottom panel 54 of the stiffener is folded to lie adjacent ends of the charge of smoking articles. Folding the bottom panel 54 inwardly towards the main panel causes a stepped region 60 knot shown in FIG. 3 but shown in FIGS. 1 and 2) to be formed by means of the cut lines 61 and crease lines 62*a*, 62*b*, 62*c* which raises at least one smoking article that contacts the stepped region relative to the other smoking articles. An inner liner 20 is then wrapped and sealed around the inner stiffener and charge of smoking articles to form an inner bundle. A laminar blank is folded around the inner bundle to form the outer housing 10 containing the bundle of smoking articles. A transparent outer wrapping film with tear tape (not shown) may be sealed around the outer housing.

The invention claimed is:

1. A container for smoking articles, comprising:

a plurality of smoking articles;

an outer housing comprising a box and a lid hingedly attached to the box, wherein the box comprises a front wall, a rear wall and opposing side walls;

an inner liner disposed within the outer housing, the inner liner defining an interior volume for the plurality of smoking articles, the inner liner being sealed around the plurality of smoking articles and having an access opening with a closure flap; and an inner stiffener having at least side walls hingedly connected to a main panel for at least partially surrounding the plurality of smoking articles within the inner liner, the main panel being hingedly connected to a bottom panel;

wherein the bottom panel includes a stepped region for receiving at least part of a smoking article provided in line with the access opening; and wherein the stepped region of the bottom panel raises the smoking article partially through the access opening relative to the other smoking articles outside of the stepped region.

2. The container of claim 1 wherein the depth and width of the stepped region corresponds to at least a radius of at least one smoking article.

3. The container of claim 2 wherein the depth and width of the stepped region corresponds to a diameter of at least one smoking article.

4. The container of claim 1 wherein the access opening extends partially into the front wall of the box and the main panel is a front panel, the stepped region of the bottom panel being provided by a hinge line between the front and bottom panels, the hinge line being at least partially stepped inwardly to create a ledge in line with the access opening.

5. The container of claim 1 wherein the access opening extends partially into the rear wall of the box and the main panel is a rear panel, the stepped region of the bottom panel being provided by a hinge line between the rear and bottom panels, the hinge line being at least partially stepped inwardly to create a ledge in line with the access opening.

6. The container of claim 1 wherein a pair of parallel longitudinal cut lines extends across the hinge line of the main and bottom panels and three parallel traverse crease lines are provided between the cut lines for folding to form the stepped region.

7. The container of claim 6 wherein a first crease line extends between ends of the cut lines in the main panel, a second crease line extends between ends of the cut line in the bottom panel and a third crease line is provided between the first and second crease lines.

8. The container of claim 7 wherein the third crease line is provided centrally between the first and second crease lines but is displaced with respect to the hinge line of the main and bottom panels.

* * * * *